US009601128B2

(12) United States Patent
Hu et al.

(10) Patent No.: US 9,601,128 B2
(45) Date of Patent: Mar. 21, 2017

(54) COMMUNICATION APPARATUS AND VOICE PROCESSING METHOD THEREFOR

(71) Applicant: HTC Corporation, Taoyuan, Taoyuan County (TW)

(72) Inventors: Chun-Ren Hu, Taoyuan (TW); Hann-Shi Tong, Taoyuan (TW); Ting-Wei Sun, Taoyuan (TW)

(73) Assignee: HTC CORPORATION, Taoyuan, Taoyuan County (TW)

( * ) Notice: Subject to any disclaimer, the term of this patent is extended or adjusted under 35 U.S.C. 154(b) by 528 days.

(21) Appl. No.: 13/772,317

(22) Filed: Feb. 20, 2013

(65) Prior Publication Data

US 2014/0236590 A1 Aug. 21, 2014

(51) Int. Cl.
*G10L 21/0208* (2013.01)
*G10L 25/84* (2013.01)
*G10L 25/48* (2013.01)

(52) U.S. Cl.
CPC ..... *G10L 21/0208* (2013.01)

(58) Field of Classification Search
CPC . G10L 21/0208; G10L 21/0272; G10L 15/20; G10L 19/26; G10L 21/02; G10L 21/0216
USPC ..... 704/208, 226, 233, 228
See application file for complete search history.

(56) References Cited

U.S. PATENT DOCUMENTS 7,881,927 B1 * 2/2011 Reuss ..... 704/226
2005/0004796 A1 * 1/2005 Trump ..... H03G 3/32 704/225
2006/0085183 A1 4/2006 Jain
2006/0167691 A1 7/2006 Tuli
2010/0020940 A1 * 1/2010 Zad-Issa ..... H04M 1/24 379/32.01
2014/0349638 A1 * 11/2014 Umezawa ..... H04M 9/082 455/419

FOREIGN PATENT DOCUMENTS

CN 101193381 A 6/2008
CN 101278337 A 10/2008
CN 102436821 A 5/2012
TW 201030733 A 8/2010
TW 201212008 A 3/2012
WO WO 9911047 A1 * 3/1999

* cited by examiner

*Primary Examiner* — Thierry L Pham
(74) *Attorney, Agent, or Firm* — Rabin & Berdo, P.C.

(57) ABSTRACT

A voice processing method for use in a communication apparatus, in an embodiment, includes the following steps. A near-end audio signal is received by at least one microphone of the communication apparatus. Voice and noise energy data are generated by performing voice activity detection on the near-end audio signal. A noise amount is obtained by performing noise energy calculation with the noise energy data. Whether the noise amount exceeds a first noise amount threshold is determined. If the noise amount exceeds the first noise amount threshold, a sidetone mode of the communication apparatus is enabled to produce a sidetone signal according to the voice energy data and play the sidetone signal through a speaker thereof. A noise suppression mode is enabled to produce a far-end audio signal according to the voice energy data and transmitting the far-end audio signal by a communication module of the communication apparatus.

11 Claims, 5 Drawing Sheets

COMMUNICATION APPARATUS AND VOICE PROCESSING METHOD THEREFOR

TECHNICAL FIELD

The disclosure relates in general to a communication apparatus and voice processing method therefor.

BACKGROUND

Users who use communication devices during phone calls frequently change the loudness of their voices due to the situation of their surrounding places. For example, the user speaks loudly in a noisy situation; the user speaks in a low voice in the situation where one needs to whisper. However, the sound quality experienced at the far-end may not be improved by the self-adjustment of loudness of voice by the one who speaks.

SUMMARY

The disclosure provides embodiments of a communication apparatus and voice processing method therefor.

According to one embodiment of the disclosure, a voice processing method is provided, for use in a communication apparatus. The embodiment includes the following steps. A near-end audio signal is received by at least one microphone of the communication apparatus. Voice energy data and noise energy data are generated by performing voice activity detection on the near-end audio signal. An amount of noise is obtained by performing noise energy calculation with the noise energy data. It is determined whether the amount of noise exceeds a first noise amount threshold. If the amount of noise exceeds the first noise amount threshold, a sidetone mode of the communication apparatus is enabled to produce a sidetone signal according to the voice energy data and to play the sidetone signal through a speaker of the communication apparatus. A noise suppression mode is enabled to produce a far-end audio signal according to the voice energy data and transmitting the far-end audio signal by a communication module of the communication apparatus.

According to another embodiment of the disclosure, a communication apparatus is provided. An embodiment of the communication apparatus includes at least a microphone, an audio processing unit, a speaker, and a communication module. At least a microphone is for receiving a near-end audio signal. The audio processing unit is operative to: perform voice activity detection on the near-end audio signal to generate voice energy data and noise energy data; perform noise energy calculation with the noise energy data to obtain an amount of noise; determine whether the amount of noise exceeds a first noise amount threshold; enable a sidetone mode to produce a sidetone signal according to the voice energy data when the amount of noise exceeds the first noise amount threshold; and enable a noise suppression mode to produce a far-end audio signal according to the voice energy data. The speaker is for playing the sidetone signal. The communication module is for transmitting the far-end audio signal.

In the following detailed description, for purposes of explanation, numerous specific details are set forth in order to provide a thorough understanding of the disclosed embodiments.

DETAILED DESCRIPTION

Embodiments of a communication apparatus and voice processing method therefor are provided as follows.

Figure 1:
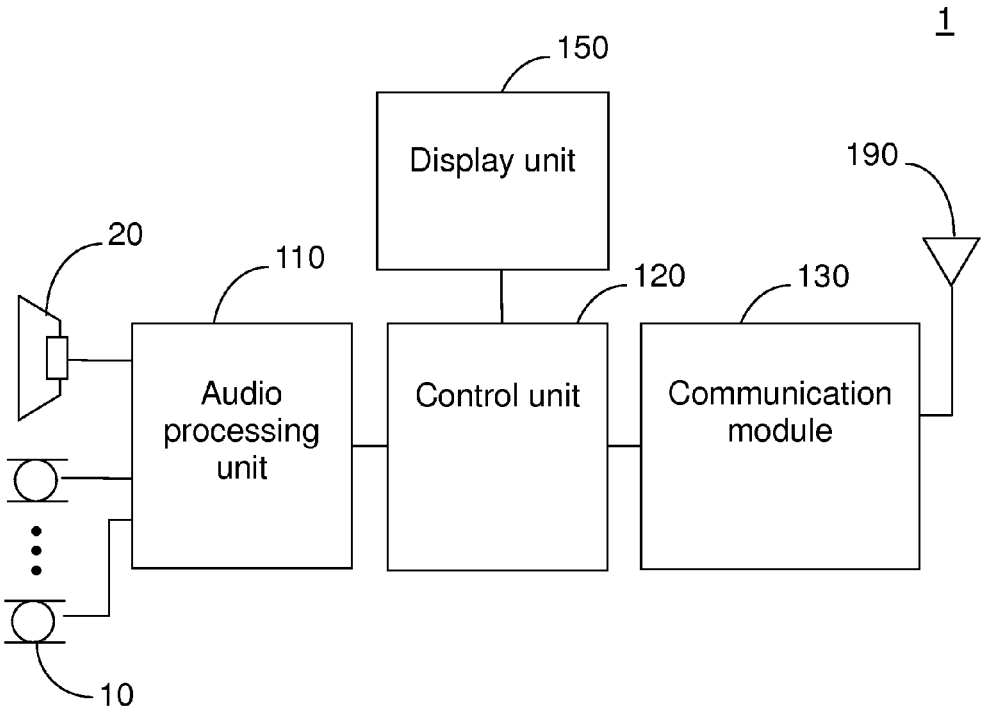
FIG. 1 illustrates a system block diagram of a communication apparatus according to an embodiment.

Referring to FIG. 1, a system block diagram illustrates a communication apparatus according to an embodiment. The communication apparatus 1 includes at least a microphone 10, a speaker 20 (such as a built-in speaker, or an external earphone or speaker), an audio processing unit 110, a control unit 120, and a communication module 130. The communication apparatus 1, when implemented as a mobile phone or tablet computer, may further include a display unit 150 and at least one antenna 190; the display unit 150, for example, includes a touch screen, and the antenna 190, for example, indicates at least one set of antennas supporting one or more communication systems, for example, at least one of the following communication systems: such as 2G, 3G, Long Term Evolution (LTE), and 4G mobile communication systems and so on, and wireless communication network.

When a user uses a communication device as shown in FIG. 1 during phone calls, one frequently changes the loudness of their voices due to the situation of their surrounding places. For example, the user speaks loudly in a noisy situation; the user speaks in a low voice in the situation where one needs to whisper.

Figure 2:
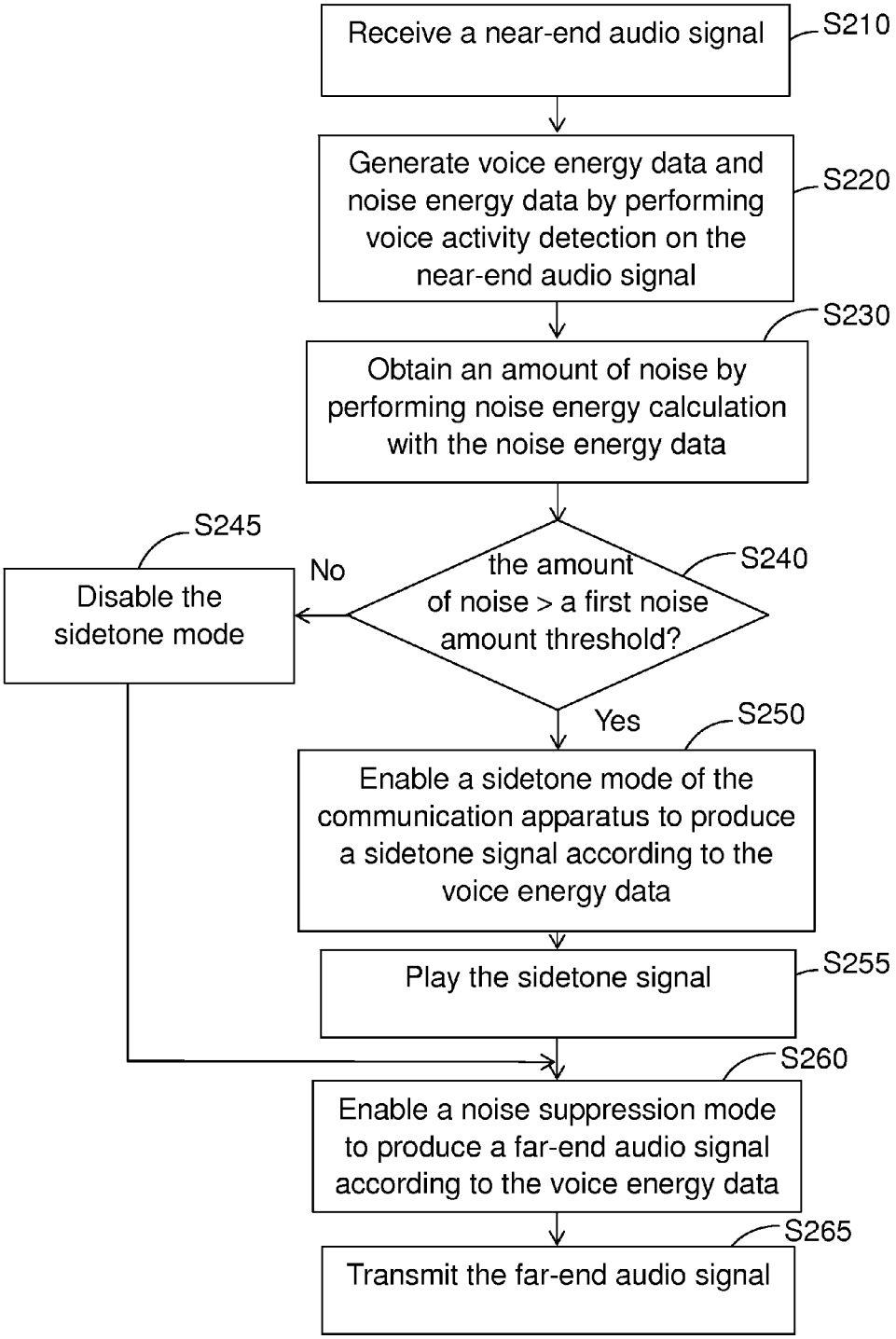
FIGS. 2-3 show flow charts of a voice processing method according to some embodiments.
Figure 3:
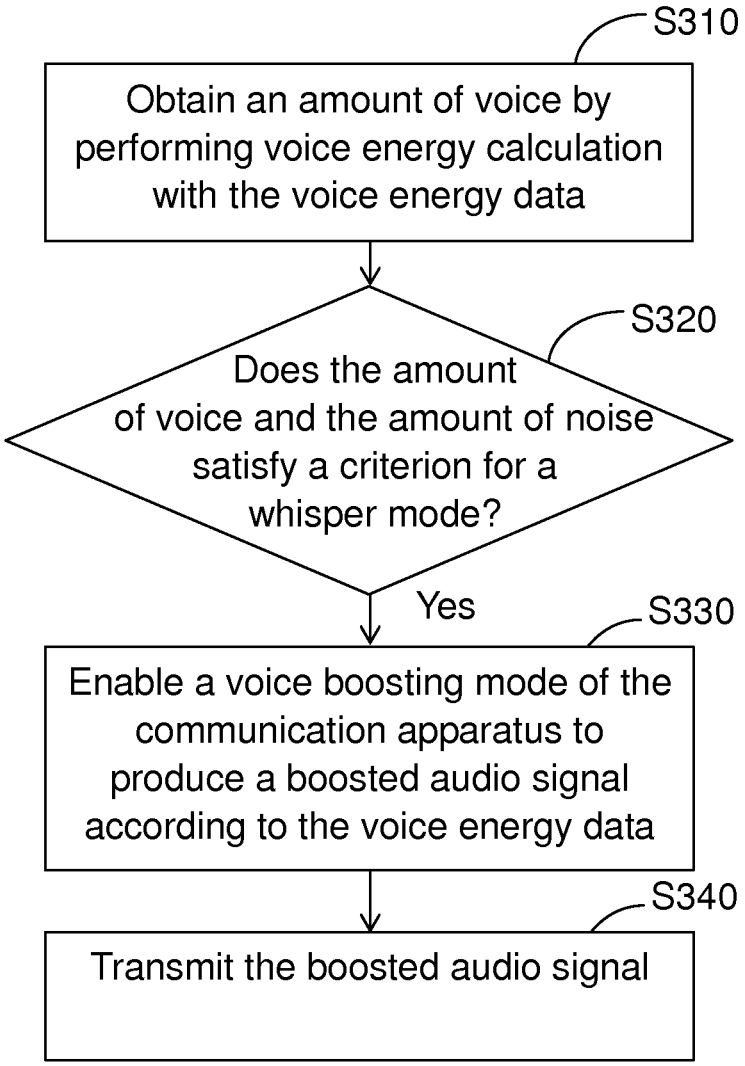

In one embodiment, the communication apparatus 1 can implement an embodiment of a voice processing method as shown in FIG. 2 in order for the far-end to receive improved sound when the user speaks loudly, thus reducing the over-loud situation of sound. In another embodiment, the communication apparatus 1 can implement another embodiment of the voice processing method as shown in FIG. 3 in order for the far-end to receive improved sound when the user speaks in whisper, thus avoiding the unclearness of sound.

Embodiments of FIG. 1 or 2 implemented by using communication apparatus 1 are provided as follows. Referring to FIG. 2, a flowchart illustrating an embodiment of a voice processing method is provided. A user, for example, makes or receives a call by a communication apparatus as shown in FIG. 1. In step S210, a near-end audio signal is received by at least one microphone 10 of the communication apparatus 1. In step S220, voice energy data and noise energy data are generated by performing voice activity detection (VAD) on the near-end audio signal. In step S230, an amount of noise is obtained by performing noise energy calculation with the noise energy data. In step S240, it is determined whether the amount of noise exceeds a first noise amount threshold. If the amount of noise exceeds the first noise amount threshold, a sidetone mode of the communication apparatus 1 is enabled to produce a sidetone signal according to the voice energy data, as indicated in step S250, and to play the sidetone signal through the speaker 20 of the communication apparatus 1, as indicated in step S255. In addition, the method may further perform step S260 to enable a noise suppression mode to produce a far-end audio signal according to the voice energy data, and transmit the far-end audio signal by the communication module 130 of the communication apparatus 1, as indicated in step S265.

In the above embodiment, playing the sidetone signal in step S250 indicates that the loudness of the speaking at the side of the communication apparatus 1 is in a high level so as to remind the user of dropping one's voice. In another embodiment according to FIG. 2, loudness corresponding to the sidetone signal is linearly dependent on loudness corresponding to the voice energy data. In this manner, the user can aware of the varying of loudness of one's voice; if the loudness of the sidetone signal is reducing, the user can then identify that one has lowered the loudness of one's voice.

In another embodiment according to FIG. 2, the method can further include step S240. If it is determined in step S240 that the amount of noise does not exceed the first noise amount threshold, the sidetone mode of the communication apparatus 1 is disabled, as indicated in step S245; for example, the sidetone signal stops playing. In this way, the user is informed that one's voice is in normal loudness.

In step S260, the enabling of the noise suppression mode to generate the far-end audio signal is to make the far-end to receive audio sound with reduced noise. Further, step S260 can be performed before or after step S250 or S245; the order in which the steps can be performed is not limited to the above embodiments.

Besides, in order to avoid the far-end from having echo during a call, echo cancellation can be performed on the near-end audio signal before performing voice activity detection, for example, before step S220, or in step S220.

Referring to FIG. 3, another embodiment of a voice processing method is shown in flowchart form. As indicated in FIG. 3, the embodiment of FIG. 2 can further include the following. In step S310, an amount of voice is obtained by performing voice energy calculation with the voice energy data. Step S320 determines whether the amount of voice and the amount of noise satisfy a criterion for a whisper mode. If the amount of voice and the amount of noise satisfy the criterion for the whisper mode, a voice boosting mode of the communication apparatus 1 is enabled to produce a boosted audio signal according to the voice energy data, as indicated in step S330, and the boosted audio signal is transmitted by the communication module 130 of the communication apparatus 1, as indicated in step S335, wherein loudness corresponding to the boosted audio signal is greater than loudness corresponding to the voice energy data and, for example, is linearly dependent on the loudness corresponding to the voice energy data.

In one embodiment, the criterion for the whisper mode in step S320 includes, for example: whether the amount of voice is less than a voice amount threshold; and whether the amount of noise is less than a second noise threshold, wherein if the amount of voice is less than the voice amount threshold and the amount of noise is less than the second noise threshold, then the criterion for the whisper mode is satisfied. Besides, the criterion for the whisper mode is not limited to this example; any other criterion, according to which a determination can be made as to whether the amount of voice and the amount of noise indicate the user whispering, can be taken as a criterion for the whisper mode. Further, in another embodiment, the first noise amount threshold can be greater than the second noise threshold.

In step S330, the communication apparatus 1 can employ filtering computation to generate the boosted audio signal based on the voice energy data, according to the nonlinear characteristics of human hearing for the sake of boosting.

Moreover, steps S220-S250, S260, S310-S330 can be implemented by the audio processing unit 110. The audio processing unit 110 can be disposed in the communication apparatus 1, as shown in FIG. 1, or can be included in a processing chip, for example, a processing chip integrating components such as the audio processing unit 110, the control unit 120 (such as an application processor) and so on.

Figure 4:
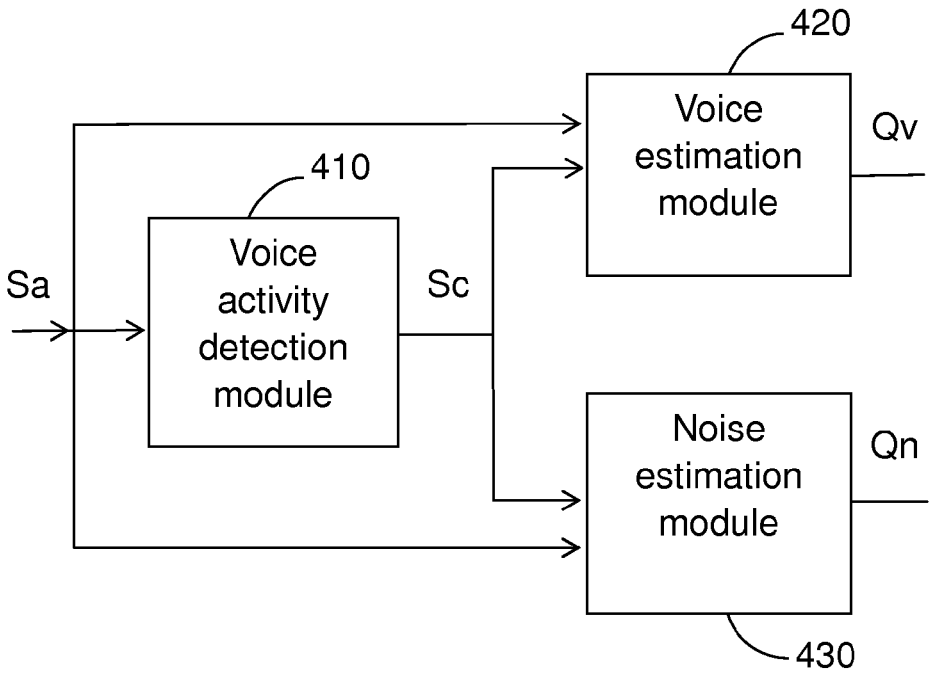
FIG. 4 illustrates a schematic diagram related to voice activity detection.

Referring to FIG. 4, a schematic diagram related to an embodiment of voice activity detection is illustrated. Steps S220, S230, S310 can be realized according to the embodiment of FIG. 4. In FIG. 4, a voice activity detection module 410 performs a voice activity detection on a digital audio signal Sa to output a detection result signal Sc. The detection result signal Sc, for example, is a signal indicating whether the digital audio signal Sa is voice or noise currently. A voice estimation module 420 receives the digital audio signal Sa and the detection result signal Sc, and performs voice energy calculation to obtain an amount of voice Qv. A noise estimation module 430 receives the digital audio signal Sa and the detection result signal Sc, and performs noise energy calculation to obtain an amount of noise Qn.

Figure 5:
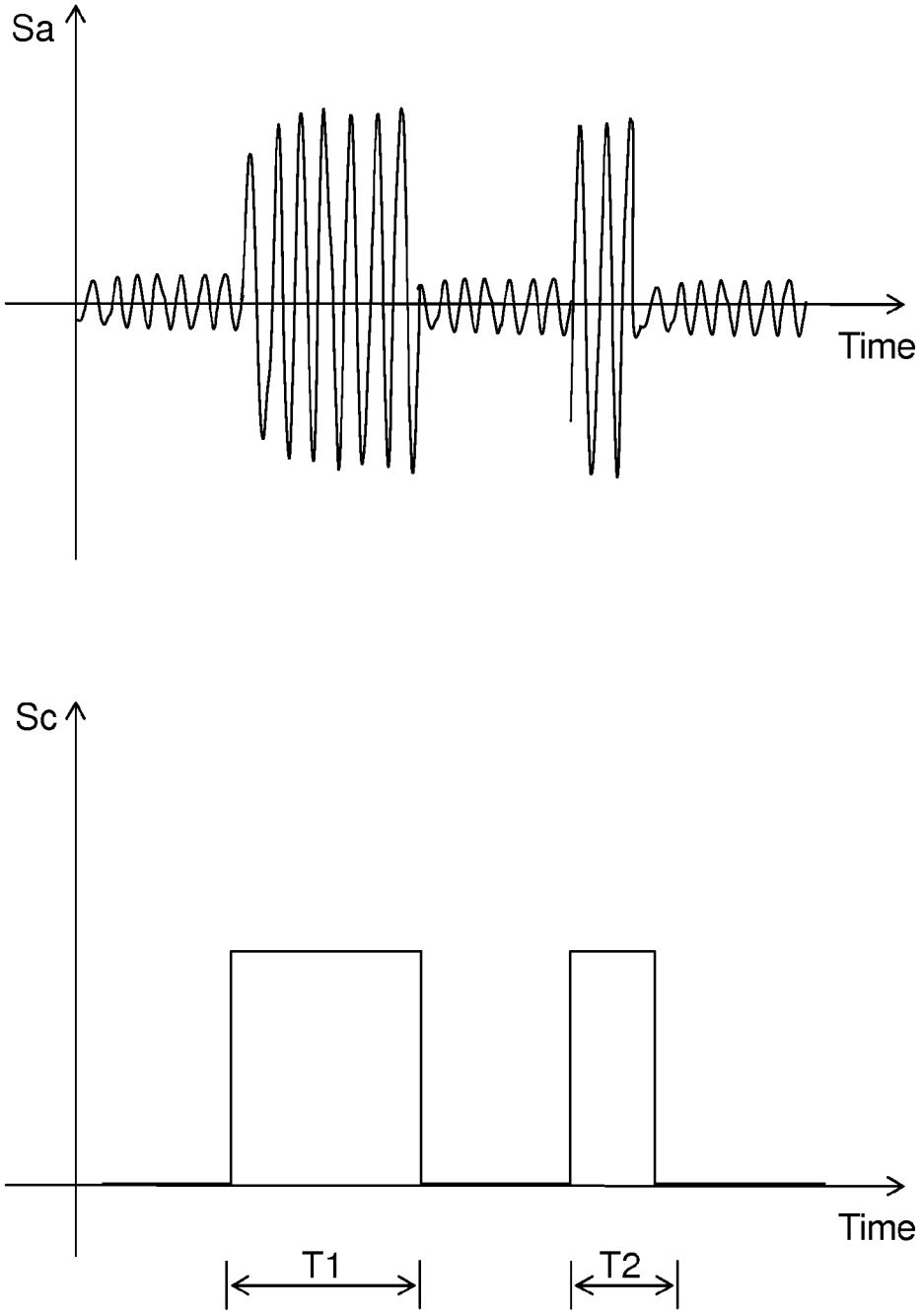
FIG. 5 illustrates a schematic diagram of a voice activity detection method.

FIG. 5 illustrates a schematic diagram of an embodiment of voice activity detection. In FIG. 5, the digital audio signal Sa, for example, is an near-end audio signal, and the voice activity detection module 410 determines whether the digital audio signal Sa is voice or noise, for example, by way of statistical computation in terms of corresponding amplitude or energy for every interval (fixed or variable) in time domain. For instance, the voice activity detection module 410 perform the statistical computation indicating that voice is presented in time intervals T1 and T2, and the detection result signal Sc has a value A, for example, 1; in the other time intervals, the detection result signal Sc has a value B, for example, 0, indicating that noise is presented.

The voice estimation module 420 can obtain a voice signal from the digital audio signal Sa according to the detection result signal Sc, and thus obtain the amount of voice. In such a way, the voice activity detection module 410 can be regarded as generating the voice energy data. In other words, for the voice estimation module 420, receiving the digital audio signal Sa and the detection result signal Sc is the same as receiving the voice energy data.

The noise estimation module 430 can also obtain a noise signal from the digital audio signal Sa according to the detection result signal Sc, and thus obtain the amount of noise. In such a way, the voice activity detection module 410 can be regarded as generating the noise energy data. In other words, for the noise estimation module 430, receiving the digital audio signal Sa and the detection result signal Sc is the same as receiving the noise energy data.

Further, every module in FIG. 4 can perform signal energy calculation by using absolute summation, squared summation, or other statistical computation for signal. As an example, the noise estimation module 430 perform absolute summation and average calculation so as to obtain the amount of noise. The other modules can also be realized similarly, and will not be shown for the sake of brevity.

In other embodiments, the voice estimation module 420 and the noise estimation module 430 can further employ smoothing technique to prevent the estimation of the amount of voice and amount of noise from being affected by short, rapid changes or errors, and to prevent the result of the determination in step S240 or S310 from being unstable or misjudgment. For instance, noise energy can be defined by $Ne=\alpha*Ne_c+(1-\alpha)*Ne_p$, wherein $0<\alpha<1$, Ne_c and Ne_p represent the current (present) noise energy value and previous noise energy value, respectively. As such, with setting a to an appropriate value, Ne can be replaced with Ne_c to smooth the current rapid change(s) of the noise energy.

The embodiments of the voice processing method are not limited by the manner of the voice activity detection as illustrated in FIG. 5. In other embodiments, the voice activity detection module 410 can output the voice energy data and noise energy data directly; the voice estimation module 420 can receive and employ the voice energy data so as to obtain the amount of voice; and the noise estimation module 430 can receive and employ the noise energy data so as to obtain the amount of noise.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A voice processing method, for use in a communication apparatus, the method comprising:

receiving a near-end audio signal by at least one microphone of the communication apparatus;

generating voice energy data and noise energy data by performing voice activity detection on the near-end audio signal;

obtaining an amount of noise by performing noise energy calculation with the noise energy data;

determining whether the amount of noise exceeds a first noise amount threshold;

if the amount of noise exceeds the first noise amount threshold, enabling a sidetone mode of the communication apparatus to produce a sidetone signal according to the voice energy data and to play the sidetone signal through a speaker of the communication apparatus;

if the amount of noise does not exceed the first noise amount threshold, disabling the sidetone mode of the communication apparatus to stop playing the sidetone signal; and enabling a noise suppression mode to produce a far-end audio signal according to the voice energy data and transmitting the far-end audio signal by a communication module of the communication apparatus.

2. The method according to claim 1, wherein the sidetone signal has a loudness level that is linearly dependent on a loudness level of the voice energy data.

3. The method according to claim 1, further comprising:

obtaining an amount of voice by performing voice energy calculation with the voice energy data;

determining whether the amount of voice and the amount of noise satisfy a criterion for a whisper mode; and if the amount of voice and the amount of noise satisfy the criterion for the whisper mode, enabling a voice boosting mode of the communication apparatus to produce a boosted audio signal according to the voice energy data and transmitting the boosted audio signal by the communication module of the communication apparatus, wherein a loudness level of the boosted audio signal is greater than the loudness level of the voice energy data and is linearly dependent on the loudness level of the voice energy data.

4. The method according to claim 3, wherein the criterion for the whisper mode includes:

whether the amount of voice is less than a voice amount threshold; and whether the amount of noise is less than a second noise threshold, wherein if the amount of voice is less than the voice amount threshold and the amount of noise is less than the second noise threshold, then the criterion for the whisper mode is satisfied.

5. The method according to claim 4, wherein the first noise amount threshold is greater than the second noise threshold.

6. A communication apparatus, comprising:

at least a microphone, for receiving a near-end audio signal;

an audio processing unit, operative to:

perform voice activity detection on the near-end audio signal to generate voice energy data and noise energy data;

perform noise energy calculation with the noise energy data to obtain an amount of noise;

determine whether the amount of noise exceeds a first noise amount threshold;

enable a sidetone mode to produce a sidetone signal according to the voice energy data when the amount of noise exceeds the first noise amount threshold;

disable the sidetone mode to stop playing the sidetone signal when the amount of noise does not exceed the first noise amount threshold; and enable a noise suppression mode to produce a far-end audio signal according to the voice energy data;

a speaker, for playing the sidetone signal; and a communication module, for transmitting the far-end audio signal.

7. The communication apparatus according to claim 6, wherein the sidetone signal has a loudness level that is linearly dependent on a loudness level of the voice energy data.

8. The communication apparatus according to claim 6, wherein audio processing unit is further operative to:

perform voice energy calculation with the voice energy data to obtain an amount of voice;

determine whether the amount of voice and the amount of noise satisfy a criterion for a whisper mode;

enable a voice boosting mode to produce a boosted audio signal according to the voice energy data when the amount of voice and the amount of noise satisfy the criterion for the whisper mode;

wherein the communication module is further operative to transmit the boosted audio signal, and a loudness level of the boosted audio signal is greater than the loudness level of the voice energy data and is linearly dependent on the loudness level of the voice energy data.

9. The communication apparatus according to claim 8, wherein the criterion for the whisper mode includes:

whether the amount of voice is less than a voice amount threshold; and whether the amount of noise is less than a second noise threshold, wherein if the amount of voice is less than the voice amount threshold and the amount of noise is less than the second noise threshold, then the criterion for the whisper mode is satisfied.

10. The communication apparatus according to claim 9, wherein the first noise amount threshold is greater than the second noise threshold.

11. The communication apparatus according to claim 6, wherein the audio processing unit is included in a processing chip.

* * * * *